US007992960B2

(12) United States Patent
Brister et al.

(10) Patent No.: US 7,992,960 B2
(45) Date of Patent: Aug. 9, 2011

(54) NON-USER-INITIATED PREVENTATIVE MAINTENACE MODES FOR INKJET-PRINTING DEVICE

(75) Inventors: Jennifer Marie McCord Brister, San Marcos, CA (US); Jeffrey Anderson, Singapore (SG); Yick Wai Yvonne Audrey Ho, Singapore (SG); Chin Hung Andy Koh, Singapore (SG); Fei Guo, Singapore (SG); Chee Beng Teo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 1226 days.

(21) Appl. No.: 11/669,472

(22) Filed: Jan. 31, 2007

(65) Prior Publication Data

US 2008/0180478 A1 Jul. 31, 2008

(51) Int. Cl.
*B41J 2/165* (2006.01)

(52) U.S. Cl. ..... 347/23; 347/33

(58) Field of Classification Search ..... 347/14, 347/23, 33

See application file for complete search history.

(56) References Cited

U.S. PATENT DOCUMENTS

| | | | | |
|---|---|---|---|---|
| 5,434,605 | A | | 7/1995 | Osborne |
| 5,455,608 | A | | 10/1995 | Stewart et al. |
| 5,583,547 | A | | 12/1996 | Gast et al. |
| 5,627,572 | A | | 5/1997 | Harrington et al. |
| 5,659,342 | A | | 8/1997 | Lund et al. |
| 5,793,388 | A | | 8/1998 | Martinson et al. |
| 5,805,182 | A | | 9/1998 | Lee |
| 5,925,177 | A | | 7/1999 | Carreira et al. |
| 5,940,185 | A | * | 8/1999 | Inoue et al. ..... 358/296 |
| 6,045,206 | A | | 4/2000 | Igval |
| 6,056,386 | A | | 5/2000 | Nohata et al. |
| 6,095,632 | A | * | 8/2000 | Kobayashi et al. ..... 347/23 |
| 6,505,911 | B1 | | 1/2003 | Hwang |
| 6,523,932 | B2 | | 2/2003 | Johnson |
| 6,550,888 | B2 | | 4/2003 | Iwata et al. |
| 6,631,976 | B2 | | 10/2003 | Hamamoto et al. |
| 6,682,164 | B2 | | 1/2004 | Vega et al. |
| 6,685,300 | B1 | | 2/2004 | Ishiyama et al. |

(Continued)

FOREIGN PATENT DOCUMENTS

JP 56126170 A * 10/1981

(Continued)

OTHER PUBLICATIONS

Sorveh, "Egg Jet Operating Manual," doc. No. WI706-(01), copyright 1995.

*Primary Examiner* — Julian D Huffman
*Assistant Examiner* — Jason S Uhlenhake

(57) ABSTRACT

One or more preventative maintenance mode parameters for an inkjet-printing device having an inkjet-printing mechanism are determined based on a water loss rate of water from ink within the device and/or on an air gain rate of air into the ink within the device. As such, periodic performance of a non-user-initiated preventative maintenance mode based on the preventative maintenance mode parameters results in the ink within the inkjet-printing mechanism being sufficiently fresh so as not to affect quality of image formation by the inkjet-printing device. Therefore, the non-user-initiated preventative maintenance mode for the inkjet-printing device is periodically performed based on the preventative maintenance mode parameters to eject at least some of the ink from, and to refill fresh ink into, the inkjet-printing mechanism.

15 Claims, 8 Drawing Sheets

U.S. PATENT DOCUMENTS

| | | | | |
|---|---|---|---|---|
| 6,896,350 | B2 | 5/2005 | Gomez et al. | |
| 6,908,166 | B2 | 6/2005 | Kobayashi et al. | |
| 6,938,971 | B2 | 9/2005 | Gomez et al. | |
| 6,945,625 | B2 | 9/2005 | Anderson | |
| 7,004,560 | B2 | 2/2006 | Yamada et al. | |
| 7,349,122 | B2 * | 3/2008 | Sakamoto et al. | 358/1.8 |
| 7,354,127 | B2 * | 4/2008 | Endo | 347/19 |
| 2002/0140961 | A1 | 10/2002 | Sum et al. | |
| 2003/0038856 | A1 * | 2/2003 | Vega et al. | 347/23 |
| 2003/0117455 | A1 | 6/2003 | Bruch et al. | |
| 2003/0151635 | A1 * | 8/2003 | Naka et al. | 347/7 |
| 2004/0080565 | A1 | 4/2004 | Vega et al. | |
| 2004/0165029 | A1 | 8/2004 | Park | |
| 2004/0212666 | A1 * | 10/2004 | Hoen et al. | 347/92 |
| 2006/0066660 | A1 | 3/2006 | Johnson | |
| 2006/0119672 | A1 | 6/2006 | Tran | |
| 2007/0035574 | A1 * | 2/2007 | Taga et al. | 347/23 |
| 2007/0097172 | A1 * | 5/2007 | Umeda | 347/32 |

FOREIGN PATENT DOCUMENTS

| | | |
|---|---|---|
| JP | 59-045163 | 3/1984 |
| JP | 03-151246 | 6/1991 |
| JP | 2002160381 | 6/2002 |

* cited by examiner

NON-USER-INITIATED PREVENTATIVE MAINTENACE MODES FOR INKJET-PRINTING DEVICE

BACKGROUND

A common way to form images on media, such as paper, is to use a fluid-ejection device, such as an inkjet-printing device. An inkjet-printing device has a number of inkjet-printing mechanisms, such as inkjet printheads. Each inkjet printhead has a number of inkjet nozzles that eject ink, such as differently colored ink, in such a way as to form a desired image on the media. Many inks are dye-based, but other inks are pigment-based, which are usually more viscous than dye-based inks.

Inkjet printheads can lose water contained within the ink through the inkjet nozzles, as well as through the body of the printheads and the tubing that delivers the ink to the printheads. When too much water is lost from the ink, the viscosity of the ink can increase, and/or the ink suspension can become unstable. Either of these situations can result in poor image formation quality.

Ink can also gain air over time through the tubing that delivers the ink to an inkjet printhead. As this ink is brought into the inkjet printhead, the dissolved air outgases from the ink as the ink is temperature-cycled through usage of the printhead. This air becomes trapped within the housing or body of the inkjet printhead, decreasing the available volume for replenishment of the ink. As a result, poor image formation quality can occur in this situation as well.

DETAILED DESCRIPTION OF THE DRAWINGS

Representative Fluid-Ejection Device

Figure 1:
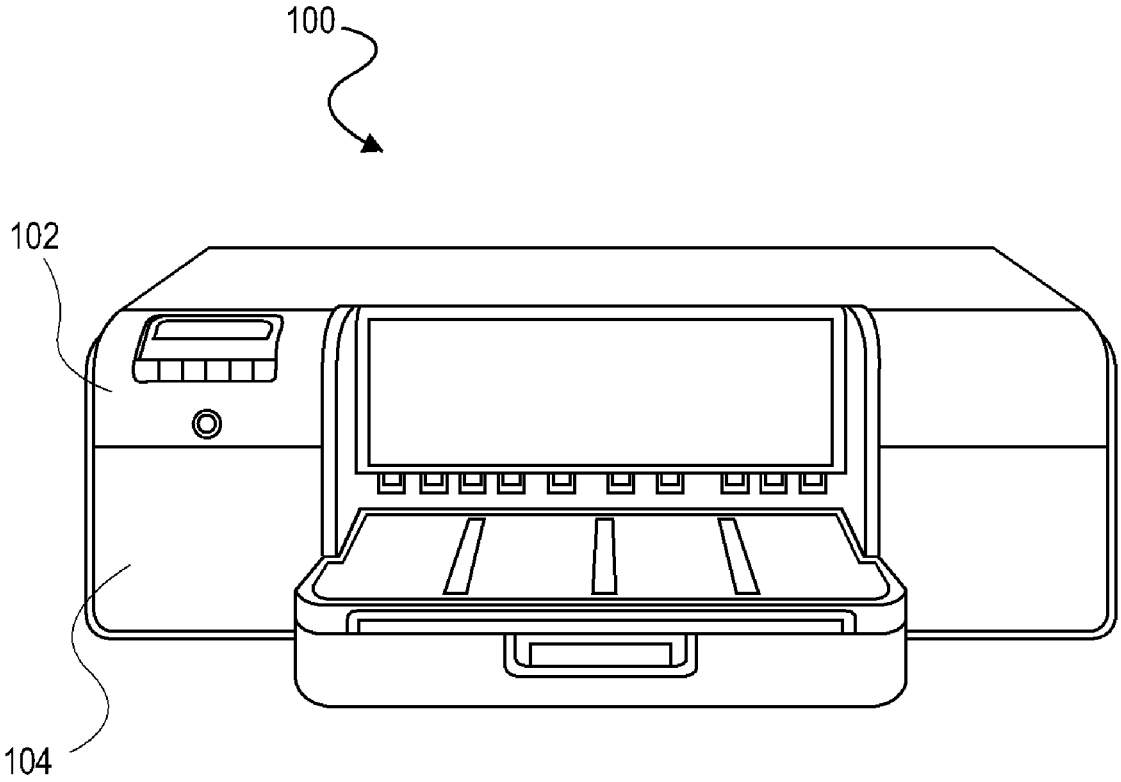
FIG. 1 is a diagram of a representative inkjet-printing device, according to an embodiment of the invention.

FIG. 1 shows a representative inkjet-printing device 100, according to an embodiment of the invention. The inkjet-printing device 100 is a device, such as a printer, that ejects ink onto media, such as paper, to form images, which can include text, on the media. The inkjet-printing device 100 is more generally a fluid-ejection device that ejects fluid, such as ink.

The inkjet-printing device 100 may eject pigment-based ink, dye-based ink, or another type of ink. Differences between pigment-based inks and dye-based inks include that the former is generally more viscous than the latter among other differences. The inkjet-printing device 100 includes at least two access doors: an access door 102, and an access door 104. The access door 104 is opened to permit a user to remove and insert ink cartridges into and from the inkjet printing device 100. The access door 102 is opened to permit a user to remove and insert inkjet printheads into and from the inkjet printing device 100.

Figure 2A:
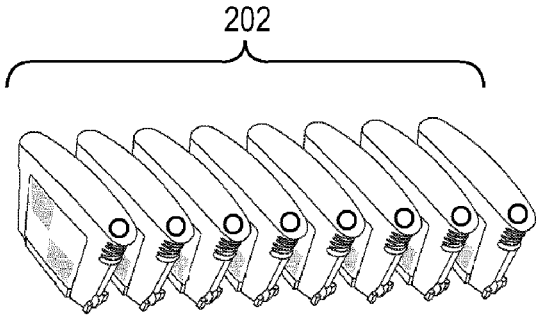
FIGS. 2A and 2B are diagrams of inkjet cartridges and how they are inserted into an inkjet-printing device, according to an embodiment of the invention.

FIG. 2A shows a number of ink cartridges 202 that may be inserted into the inkjet-printing device 100, according to an embodiment of the invention. In one embodiment, there may be eight such ink cartridges 202. These ink cartridges 202 may include photo black pigment-based ink cartridge, a light gray pigment-based ink cartridge, and a matte black pigment-based ink cartridge. These ink cartridges 202 may further include a cyan pigment-based ink cartridge, a magenta pigment-based ink cartridge, a yellow pigment-based ink cartridge, a light magenta pigment-based ink cartridge, and a light cyan pigment-based ink cartridge. Having eight such ink cartridges 202 enables the inkjet-printing device 100 to print photorealistic full-color images on media.

In another embodiment, however, there may be just four ink cartridges 202. The ink cartridges 202 in this embodiment may include black, cyan, magenta, and yellow ink cartridges. Having four such ink cartridges enables the inkjet-printing device 100 to print full-color images on media, but generally not as photorealistic as when there are eight ink cartridges 202. In still another embodiment, there may be just a single black ink cartridge 202. In this embodiment, the inkjet-printing device 100 can print black-and-white and grayscale images on media, but not color images.

Figure 2B:
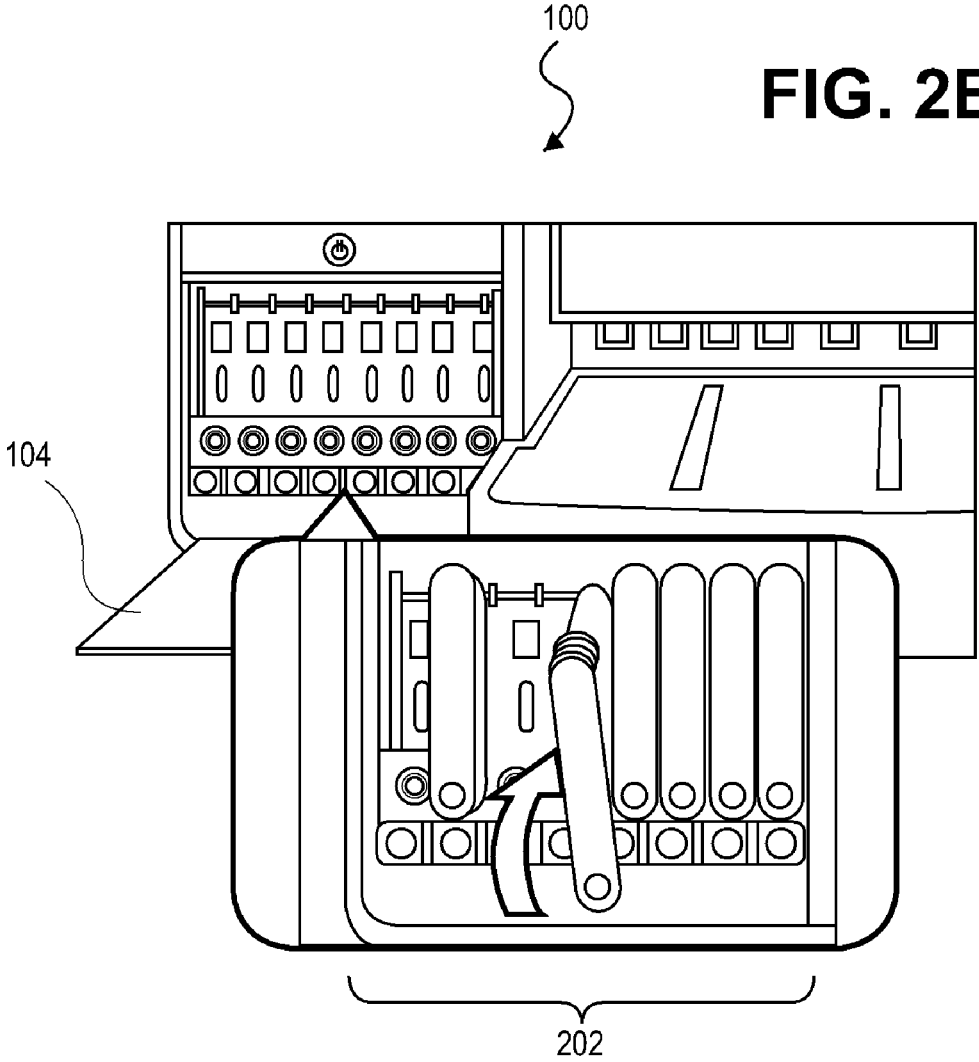

FIG. 2B shows how the ink cartridges 202 may be inserted into the inkjet-printing device 100, according to an embodiment of the invention. The access door 104 is opened downwards. Opening the access door 104 reveals a number of slots. The ink cartridges 202 can be inserted into and removed from these slots of the inkjet-printing device 100. The ink cartridges 202 supply the differently colored ink by which the inkjet-printing device 100 forms images on media. The inkjet cartridges 202 are more generally fluid supplies, such as supplies of ink.

Figure 3A:
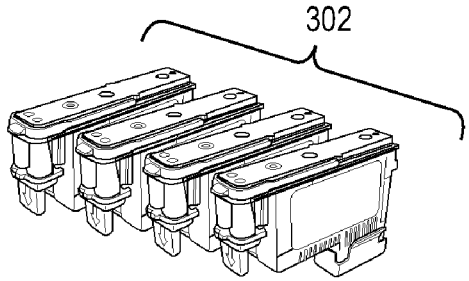
FIGS. 3A and 3B are diagrams of inkjet printheads and how they are inserted into an inkjet-printing device, according to an embodiment of the invention.

FIG. 3A shows a number of inkjet printheads 302 that may be inserted into the inkjet-printing device 100, according to an embodiment of the invention. The inkjet printheads 302 are more generally fluid-ejection mechanisms, in that they are the actual mechanisms that eject fluid, such as ink, onto media to form images on the media. There may be four such inkjet printheads 302 in one embodiment of the invention. One inkjet printhead may be responsible for ejecting photo black and light gray ink. Another inkjet printhead may be responsible for ejecting matte black and cyan ink. A third inkjet printhead may be responsible for ejecting magenta and yellow ink. The last inkjet printhead may be responsible for ejecting light magenta and light cyan ink.

In another embodiment, however, there may be just two inkjet printheads 302, in the case where there are just four differently colored inks, cyan, magenta, yellow, and black. One of these inkjet printheads may be responsible for ejecting black ink, whereas the other printhead may be responsible for ejecting cyan, magenta, and yellow ink. In still another embodiment, there may be just a single inkjet printhead, in the case where there is just black ink, such that the single inkjet printhead ejects this black ink.

Figure 3B:
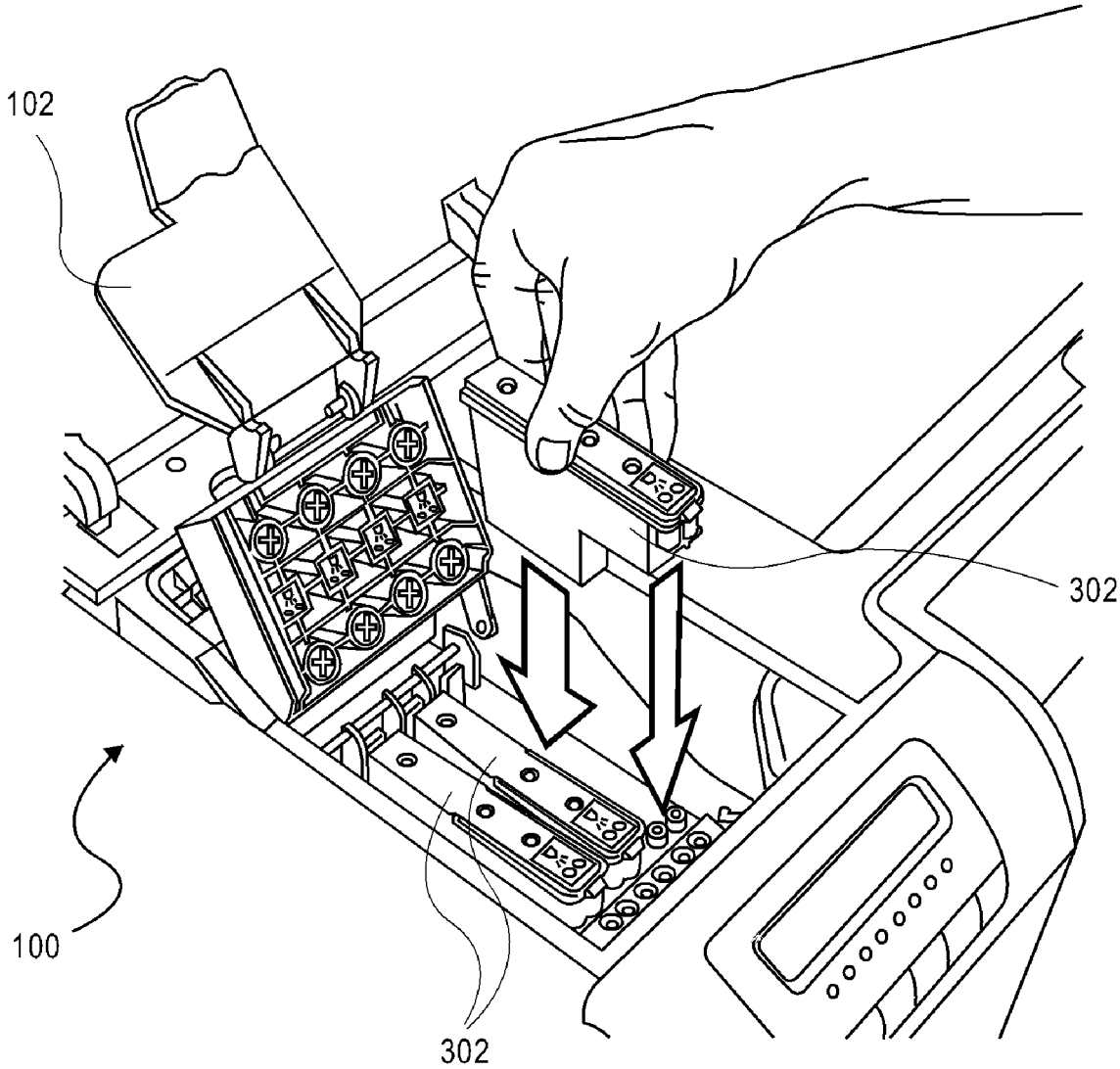

FIG. 3B shows how the inkjet printheads 302 may be inserted into the inkjet-printing device 100, according to an embodiment of the invention. The access door 102 is opened upwards. Opening the access door 102 reveals a number of slots. The inkjet printheads 302 can be inserted into and removed from these slots of the inkjet-printing device 100. The inkjet printheads 302 thus eject the ink supplied by the ink cartridges 202 to form images on media.

The embodiments of the invention that have been described in relation to FIGS. 2A, 2B, 3A, and 3B employ ink supplies—the ink cartridges 202—that are separate from the inkjet printheads 302. However, in another embodiment, the inkjet cartridges 202 may be integrated within the inkjet printheads 302. That is, the inkjet printheads 302 may themselves include supplies of ink, such that there are no separate inkjet cartridges 202 per se to be inserted into and removed from the inkjet-printing device 100.

Figure 4:
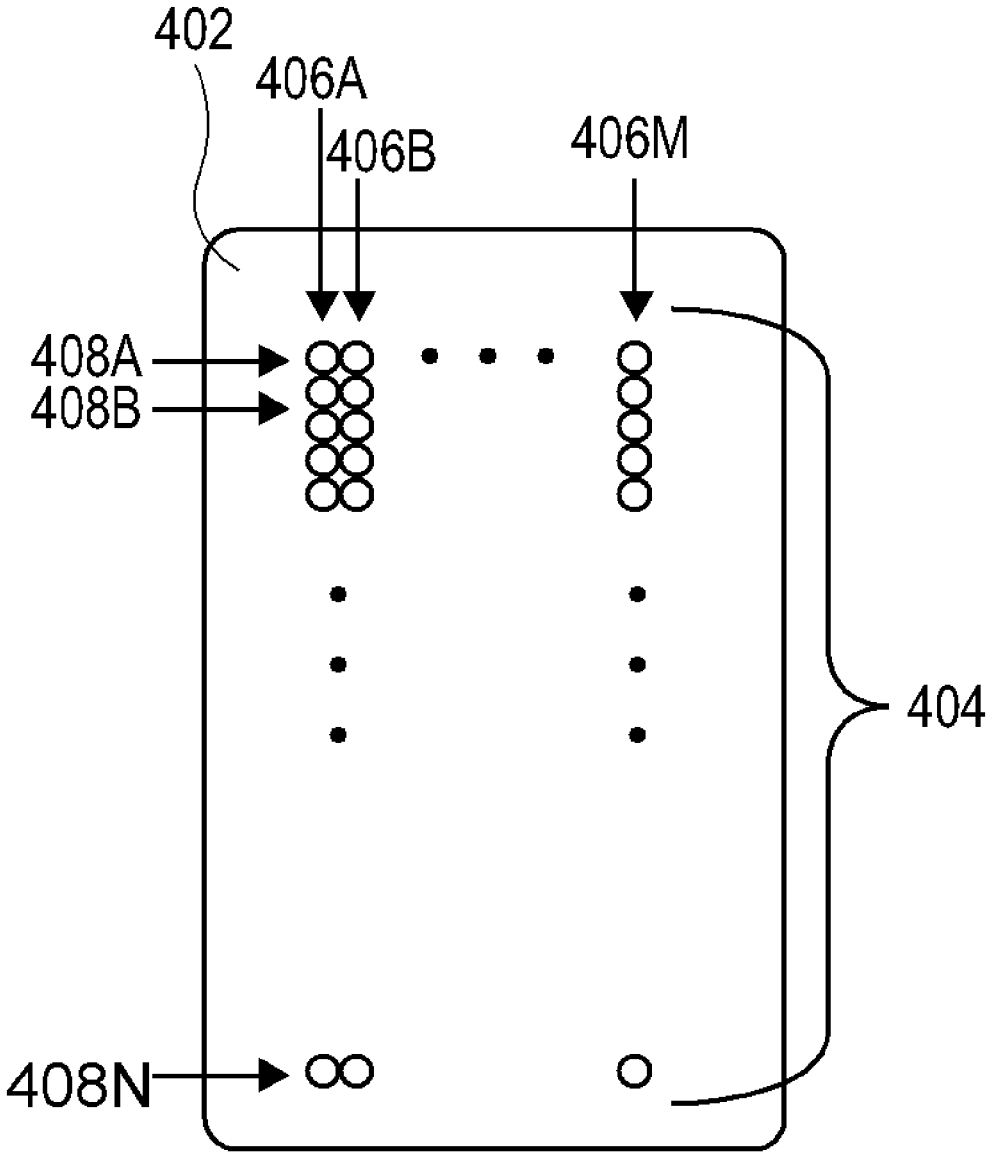
FIG. 4 is a diagram of an inkjet printhead having a number of inkjet nozzles, according to an embodiment of the invention.

FIG. 4 shows a detailed view of an inkjet printhead 402, according to an embodiment of the invention. The inkjet printhead 402 exemplifies each of the inkjet printheads 302 that have been described. The side of the inkjet printhead 402 from which ink is actually ejected is specifically depicted in FIG. 4.

The inkjet printhead 402 includes a number of inkjet nozzles 404, which may more generally be referred to as fluid-ejection nozzles. The inkjet nozzles 404 are organized over a number of columns 406A, 406B, . . . , 406M, collectively referred to as the columns 406, and a number of rows 408A, 408B, . . . , 408N, collectively referred to as the rows 408. In one embodiment, for example, there may be four columns 406 and 523 rows 408, for a total of 2,112 inkjet nozzles 404.

The inkjet nozzles 404 are the orifices from which ink, or fluid, is ejected out of the inkjet printhead 402. The surface of the inkjet printhead 402 shown in FIG. 4 may be referred to as the orifice plate, which comes into close contact with the media so that ink can be precisely ejected from the inkjet nozzles 404 onto the media in a desired manner. The inkjet nozzles 404, especially in the case where the ink is a pigment-based ink, are susceptible to clogging.

Figure 5:
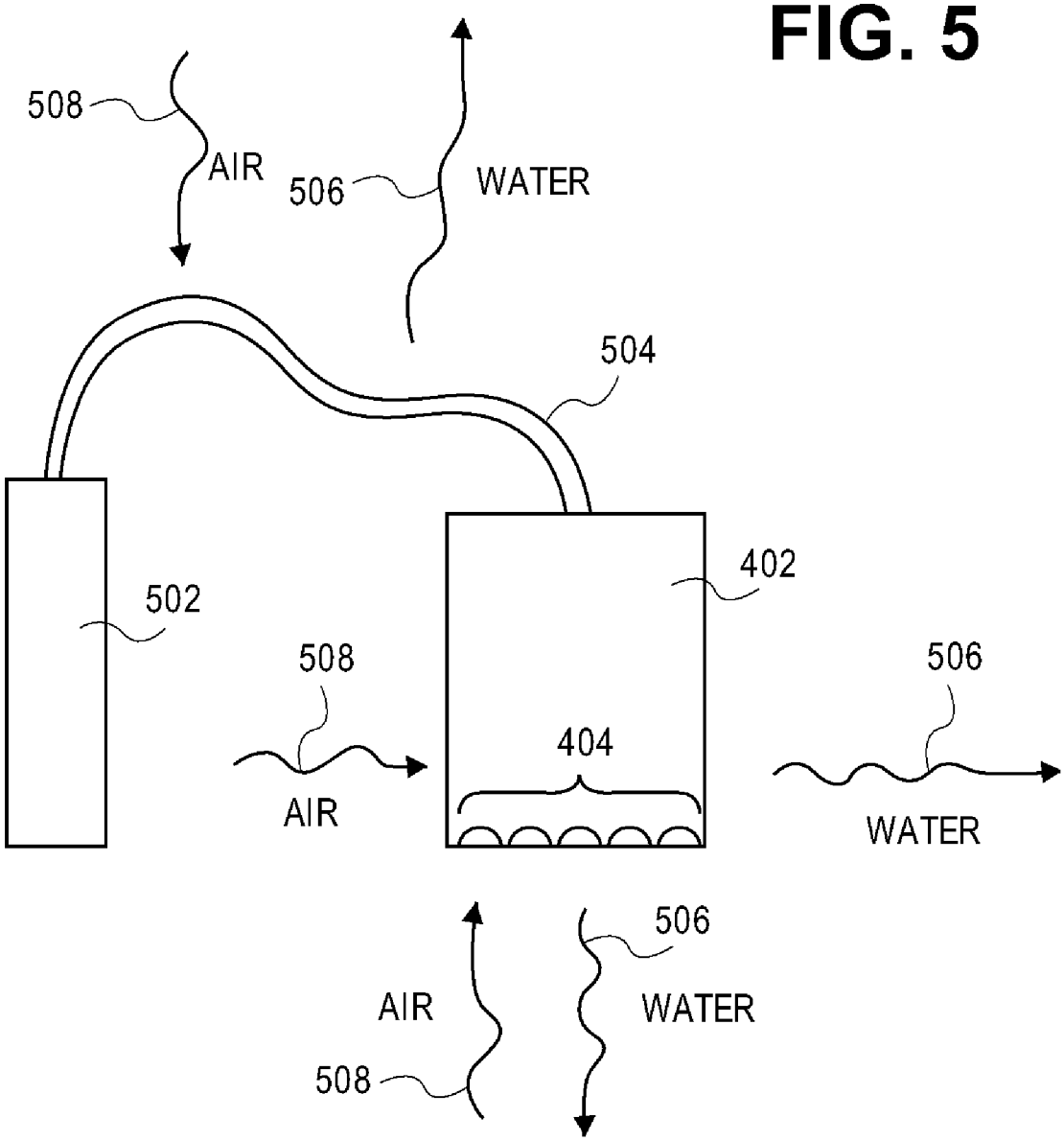
FIG. 5 is a diagram depicting an ink cartridge supplying ink to an inkjet printhead via tubing, according to an embodiment of the invention.

FIG. 5 shows diagrammatically how ink can be supplied from an ink cartridge 502 to the inkjet printhead 402, according to an embodiment of the invention. The ink cartridge 502 exemplifies each of the ink cartridges 202 that have been described. Tubing 504 connects the ink cartridge 202 to the inkjet printhead 402, so that ink can be supplied to the printhead 402 for ejection by the inkjet nozzles 404.

When the inkjet printhead 402 remains unused for a period of time, and thus does not eject ink from the inkjet nozzles 404 thereof, two undesirable effects may transpire. First, water may be lost from the ink contained within the tubing 504, the inkjet nozzles 404, and/or the body of the inkjet printhead 402 itself, as indicated by arrows 506 in FIG. 5. As has been noted in the background section, too much water loss results in the viscosity of the ink increasing, and/or the ink suspension becoming unstable. Either of these situations can result in poor image formation quality when the inkjet printhead 402 is called upon to form an image on media by ejection of ink from the inkjet nozzles 404.

Second, air may be gained within the ink within the tubing 504, the inkjet nozzles 404, and/or the body of the inkjet printhead 402 itself, as indicated by arrows 508 in FIG. 5. As has also been noted in the background section, too much air gain results in such dissolved air outgassing from the ink as the ink is subsequently temperature-cycled through usage of the inkjet printhead 402. This air becomes trapped within the housing or body of the inkjet printhead 402 itself, decreasing the available volume for ink replenishment from the ink cartridge 502 via the tubing 504. Poor image formation quality can thus also result when the inkjet printhead 402 is called upon to form an image on media by ejection of ink from the inkjet nozzles 404.

Embodiments of the invention are concerned with periodic performance of a non-user-initiated preventative maintenance mode of the inkjet printhead 402 to prevent these situations from occurring. In particular, by periodically performing such preventative maintenance that is not user-initiated, when the user subsequently initiates image formation on media by the inkjet nozzles 404 of the inkjet printheads 402, the ink contained within the printhead 402 will not be suffering from undue water loss or air gain. As a result, the image formed on the media will not as likely be degraded than where undue water loss and/or air gain occurs.

Non-User-Initiated Preventative Maintenance

Figure 6:
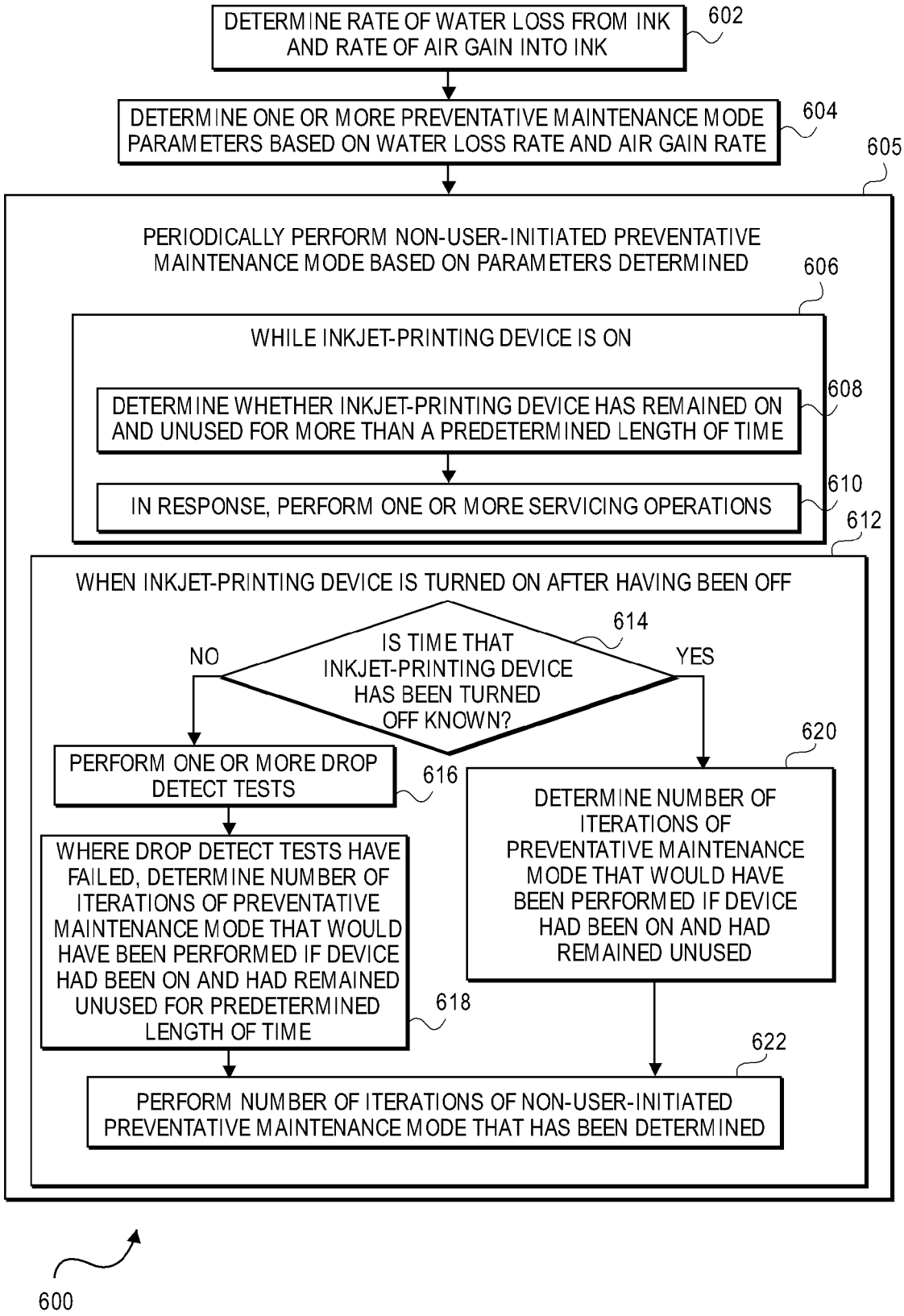
FIG. 6 is a flowchart for performing periodic, non-user-initiated preventative maintenance of an inkjet-printing device, according to an embodiment of the invention.

FIG. 6 shows a method 600 for non-user-initiated preventative maintenance of the inkjet-printing device 100, according to an embodiment of the invention. At least some parts of the method 600 can be performed by or within the inkjet-printing device 100 itself. The preventative maintenance of the method 600 is not user initiated. Such a non-user-initiated preventative maintenance mode can also be referred to as a "gremlin" mode, insofar as it is typically performed when the inkjet-printing device 100 is powered on, but is not currently being actively used by a user to form images on media, such as paper.

Initially, the rate of water loss from the ink within the inkjet-printing device 100 and the rate of air gain into this ink is determined (602), and one or more preventative maintenance mode parameters are determined based on this water loss rate and this air gain rate (604). The rate of water loss from the ink, as exemplified by FIG. 5 as has been described, is empirically determined. Likewise, the rate of air gain into the ink, as also exemplified by FIG. 5 as has been described, is empirically determined. For example, the designers or engineers of a particular inkjet-printing device 100 may perform testing to determine the rate of water loss and the rate of air gain, as can be appreciated by those of ordinary skill within the art.

The non-user-initiated preventative maintenance mode parameters can include two parameters in particular: how often the preventative maintenance mode is to be determined, and how much ink is to be ejected when the preventative maintenance mode is performed. Other types of parameters may also be determined. The frequency at which the preventative maintenance mode is performed, together with how much ink is to be ejected when the preventative maintenance mode is performed, are typically empirically determined. Specifically, the water loss rate and the air gain rate, when left uncorrected, at some point will cause subsequently initiated image formation by the inkjet-printing device 100 to suffer from image quality degradation.

Therefore, how often the preventative maintenance mode is performed, and how much ink is ejected when this mode is performed, are determined so that image quality degradation does not result when the inkjet-printing device 100 is called upon to form images on media. For example, it may be empirically determined that if the inkjet-printing device 100 remains unused for four days, then image quality degradation results. Therefore, the preventative maintenance mode is determined to be performed at least every four days that the inkjet-printing device 100 remains unused. It may also be empirically determined that when the inkjet-printing device 100 remains unused for four days, 0.33 cubic centimeters (cc) of ink has to be ejected to replenish the ink within the inkjet printhead 402 such that image quality degradation does not result when the inkjet-printing device 100 is called upon to form images on media. Therefore, the preventative maintenance mode is performed such that at least 0.33 cc of ink is ejected from the inkjet nozzles 404 of the inkjet printhead 402.

It is noted that the water loss rate and the air gain rate determined in part 602 of the method 600, and the non-user-initiated preventative maintenance mode parameters determined in part 604 of the method 600, are usually particular to a given type of inkjet-printing device 100. That is, they are particular to a given type of inkjet printhead 402 employed within the inkjet-printing device 100, having a given type and number of inkjet-printing nozzles 404, and a given type of ink supplied by the inkjet cartridge 502. In addition, the water loss rate, the air gain rate, and the parameters are particular to a given type of tubing 504 that supplies the ink from the inkjet cartridge 502 to the inkjet printhead 402. This is why the water loss rate, the air gain rate, and the non-user-initiated preventative maintenance mode parameters are typically empirically determined.

The non-user-initiated preventative maintenance mode parameters may be programmed into the inkjet-printing device 100, such that the non-user-initiated preventative maintenance mode is periodically performed (605). As has been noted, the preventative maintenance mode is not user-initiated, but rather is initiated by the inkjet-printing device 100 itself. Furthermore, the preventative maintenance mode is typically performed when the inkjet-printing device 100 is idle, and is not currently ejecting ink onto media in response to a user-initiated print job to form a desired image on the media. In these respects, the preventative maintenance mode of embodiments of the invention differs from conventional preventative maintenance modes that may have to be initiated by the user. Because users often forgot to initiate such preventative maintenance, embodiments of the invention are advantageous.

The non-user-initiated preventative maintenance mode is periodically performed in two specific situations: while the inkjet-printing device 100 is on (606)—i.e., while the inkjet-printing device 100 has been on for a length of time—and, when the inkjet-printing device 100 is turned on after having been turned off for a length of time (608). In the former case, the inkjet-printing device 100 keeps track of how long it has remained on and unused. When it has been determined that the inkjet-printing device 100 has remained on and unused for more than a predetermined length of time (608), then one or more servicing operations are performed as the non-user-initiated preventative maintenance mode (610).

For example, the predetermined length of time may be four days. This period of time can correspond to the typical five-day work week of a user, where the user may turn on the inkjet-printing device 100 when he or she arrives at work on Monday morning, and where the user may then turn off the device 100 when he or she leaves work on Friday evening. Therefore, having the predetermined length of time set at four days ensures that the inkjet-printing device 100 performs a non-user-initiated preventative maintenance mode one time during the work week if the user does not use the device 100 during the work week.

Performance of the servicing operations of the preventative maintenance mode is designed to result in the ink within the inkjet printhead 402 being sufficiently fresh so as not to affect image formation quality when the inkjet-printing device 100 is called upon to form images on media. Thus, performance of the preventative maintenance mode ejects at least some of the ink from the inkjet printhead 402. This results in the refilling of fresh ink from the ink cartridge 502 into the inkjet printhead 402. The service operations are performed with sufficient regularity so that water loss and air gain within the inkjet-printing device 100 do not reach the level at which they compromise the ink within the inkjet printhead 402 and undesirably affect image formation quality.

The servicing operations performed may include a series of spit-wipe operations. Each spit-wipe operation in turn includes one or more spit operations and one or more wipe operations. A spit operation ejects a predetermined amount of ink from the inkjet nozzles 404 of the inkjet printhead 402. A wipe operation wipes the inkjet nozzles 404 of the inkjet printhead 402. In one embodiment, substantially 11,000 drops of ink (either per nozzle or per color) may be ejected from the inkjet nozzles during each spit operation, where each wipe operation is preceded by a spit operation. There may be a total of three such spit-wipe operations performed in one embodiment of the invention.

Figure 7:
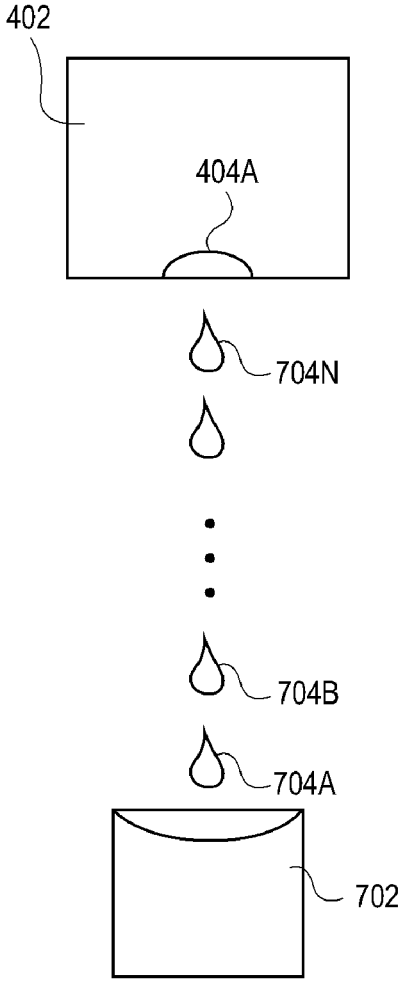
FIG. 7 is a diagram depicting a representative drop detect test, according to an embodiment of the invention.

FIG. 7 illustratively shows a spit operation, according to an embodiment of the invention. Just a single inkjet nozzle 404A of the inkjet printhead 402 is depicted in FIG. 7 for illustrative clarity and convenience. The inkjet nozzle 404A is fired multiple times at high frequency, such as 6,000 Hertz, where each time the inkjet nozzle 404A is fired, desirably one of the ink droplets 704A, 704B, . . . , 704N, collectively referred to as the ink droplets 704, is ejected from the nozzle 404A. The total volume of the ink droplets 704 is the amount of ink ejected by the nozzle 404A during the spit operation. The ink droplets 704 are collected within a spittoon 702, and may later evaporate, or the spittoon 704 may be periodically emptied.

Figure 8:
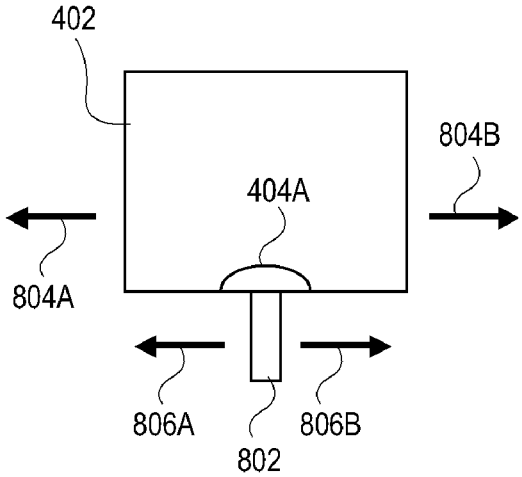
FIG. 8 is a diagram depicting a representative spit operation, according to an embodiment of the invention.

FIG. 8 illustratively shows a wipe operation, according to an embodiment of the invention. Just a single inkjet nozzle 404A of the inkjet printhead 402 is depicted in FIG. 8 for illustrative clarity and convenience. In one embodiment, the inkjet printhead 402 is moved back and forth as indicated by arrows 804A and 804B so that the inkjet nozzle 404A is moved back and forth against a stationary wiper 802. The wiper 802 may be a polymer tab, or another type of wiper. In another embodiment, the inkjet printhead 402 remains stationary, and the wiper 802 is moved back and forth against the inkjet nozzle 404A, as indicated by arrows 806A and 806B.

Periodically performing the non-user-initiated preventative maintenance mode while the inkjet-printing device 100 is on in part 606 of the method 600 of FIG. 6 increases usage of the inkjet-printing device 100 such that the average age of the ink within the inkjet printhead 402 of the device 100 decreases. For example, the designers or engineers of the inkjet-printing device 100 may empirically survey usage of the inkjet-printing device 100 by a large number of users. Below the eighteenth percentile of these users of the inkjet-printing device 100, the average age of the ink within the inkjet printhead 402 may be old enough to result in image formation quality degradation due to water loss and air gain.

Therefore, increasing the usage of the inkjet-printing device 100 by periodically performing the non-user-initiated preventative maintenance mode forces the average age of the ink within the inkjet printhead 402 to decrease. As a result, for instance, the ink usage of the fifth percentile of the users of the inkjet-printing device 100 (where no preventative maintenance is performed) may increase to the level of ink usage of the eighteenth percentile of the users of the device 100. Although periodic performance of the preventative maintenance mode thus does increase ink usage, the net effect is beneficial, in that image formation quality does not degrade due to water loss and air gain. It can therefore be said that periodically performing the non-user-initiated preventative maintenance mode increases usage of the inkjet-printing device 100 such that the average age of the ink within the inkjet printhead 402 decreases to that of a X-percentile user (e.g., such as the eighteenth percentile) and does not reach that of a Y-percentile user (e.g., such as the fifth percentile).

Still referring to FIG. 6, the non-user-initiated preventative maintenance mode is further performed when the inkjet-printing device 100 has been turned on after having been turned off (612). The time that the inkjet-printing device 100 has been turned off may be known or unknown. For example, if the inkjet-printing device 100 has non-volatile memory, and/or an internal time clock, then the device 100 may be able to track how long it has been turned off once the device 100 is turned on again. Alternatively, if the inkjet-printing device 100 lacks such non-volatile memory, and/or an internal time clock, then the device 100 may not be able to track how long it has been turned off once the device 100 is turned on again.

If the time that the inkjet-printing device 100 has been turned off is unknown (614), then the method 600 may perform one or more drop detect tests (616) in one embodiment of the invention, to determine whether the inkjet nozzles 404 of the inkjet printhead 402 are properly ejecting ink. A drop detect test determines which and how many of the inkjet nozzles 404 of the inkjet printhead 402 are properly ejecting ink, as opposed to, for instance, being clogged. Drop detect tests include electrostatic drop detect tests and optical drop detect tests, among other types of drop detect tests. An electrostatic drop detect test detects the charge of an ink drop that is induced upon the ink drop by an electrostatic field. The amount of charge that is detected by a capacitive sensor is related to the amount of ink that is deposited on the target. By comparison, an optical drop detect test optically determines whether and how much ink has been deposited on a target. For instance, an ink drop may pass through a light beam, breaking up the light beam such that it is known that the drop has been ejected. A spot sensor may further be used to scan a target to determine whether a drop is present, and if so, the size of the drop.

Thus, the drop detect test can be performed in one embodiment as follows. First, the inkjet printhead 402 is moved so that it is aimed against a drop detector, which is another term for a drop detect target. The inkjet nozzles 404 of the inkjet printhead 402 are then fired. Based on where and how much ink is deposited on the drop detect target, it can be determined which and how many of the inkjet nozzles 404 successfully (and actually) ejected ink.

Figure 9:
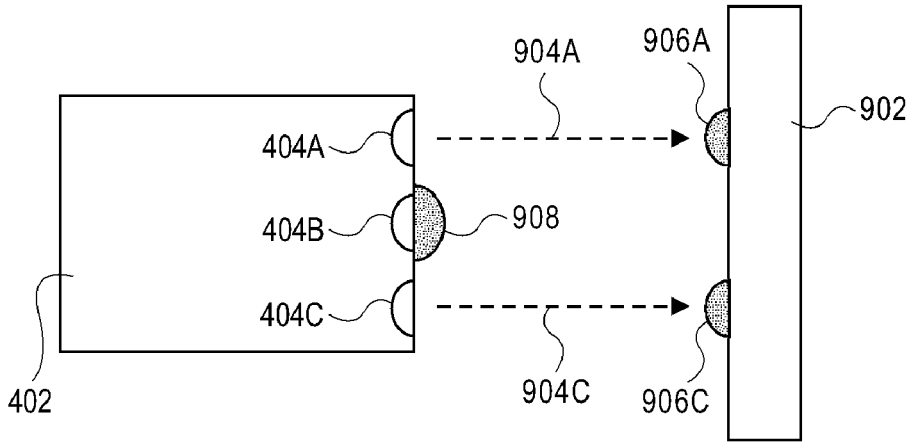
FIG. 9 is a diagram depicting a representative wipe operation, according to an embodiment of the invention.

FIG. 9 illustratively shows a drop detect test, according to an embodiment of the invention. Just three inkjet nozzles 404A, 404B, and 404C of the inkjet printhead 402 are depicted in FIG. 9 for illustrative convenience. The inkjet printhead 402 is aimed against a drop detector 902, which may also be referred to as a drop detect target. The inkjet nozzles 404A, 404B, and 404C are then fired to cause them to eject ink.

As indicated by the arrows 904A and 904C, the inkjet nozzles 904A and 904C ejected ink 906A and 906C, respectively, against the drop detector 902. The drop detector 902 is able to detect this ink 906A and 906C, and correspond the ink 906A and 906C to the inkjet nozzles 404A and 404C, so that it can be concluded that the inkjet nozzles 404A and 404C properly ejected ink. By comparison, however, dried ink 908, or sludge, has formed over the inkjet nozzle 404B. As a result, the inkjet nozzle 404B did not successfully and properly eject ink, such that the drop detector 902 did not detect any ink being deposited thereon as a result of the inkjet nozzle 404B firing.

In one embodiment, where results of the drop detect tests indicate failure of the inkjet printhead 402 according to a given criterion, then it is determined how many iterations of the preventative maintenance mode would have been performed if the inkjet-printing device 100 had been on and had remained unused for a predetermined length of time (618). The criterion may be that more than twenty of the inkjet nozzles 404 failed to eject ink during the last-performed drop detect test. In another embodiment, the drop detect tests of part 616 are not performed, and instead part 618 is automatically performed without first performing such drop detect tests.

The predetermined length of time on which basis it is determined how many iterations of the preventative maintenance mode would have been performed if the inkjet-printing device 100 had been on and had remained unused may be four weeks in one embodiment of the invention. Because there are twenty-eight days in four weeks, where the inkjet-printing device 100 performs a non-user-initiated preventative maintenance mode every four days of non-use, this means that seven such iterations of the preventative maintenance mode would have been performed if the device 100 had been on and had remained unused for four weeks. This predetermined length of time may be empirically determined, as can be appreciated by those of ordinary skill within the art, or arbitrarily specified.

For example, the designers and/or the engineers of the inkjet-printing device 100 may find that after four weeks of the inkjet-printing device 100 remaining on and not being used, seven iterations of the preventative maintenance mode is sufficient to replenish the water-depleted ink within the inkjet printhead 402. That is, even if the inkjet-printing device 100 remained on and idle for more than four weeks, no more than seven iterations of the preventative maintenance mode may be needed to replenish the ink within the inkjet printhead 402. Therefore, the predetermined length of time is set as four weeks, which is the length of time in which seven such iterations of the preventative maintenance mode would normally be performed.

If, on the other hand, the time that the inkjet-printing device 100 has been turned off is known (614), then the method 600 just determines the number of iterations of the preventative maintenance mode that would have been performed if the device 100 had been on and idle during this time (620). For example, if the inkjet-printing device 100 had been turned off for eight days, and where the non-user-initiated preventative maintenance mode is normally performed every four days, then two iterations of the preventative maintenance mode would have been performed during this length of time in which the device 100 was turned off. The number of iterations determined in part 620 may be capped at a predetermined maximum number. For instance, as noted above, there may be no need to perform more than seven iterations of the preventative maintenance mode to properly replenish the ink within the inkjet printhead 402. Therefore, if the number of iterations that the inkjet-printing device 100 would normally have performed if it had been on and idle is greater than seven, this number may nevertheless be capped at seven. In one embodiment, part 620 may be preceded by performance of a drop detect test, similar to how part 618 is preceded by the drop detect test of part 616, such that part 620 is proceeded to just if this drop detect test fails.

After performing part 618 or part 620, the method 600 proceeds to perform the number of iterations of the non-user-initiated preventative maintenance mode that has been determined (622). Such performance of the preventative maintenance mode may be the same as the one or more servicing operations performed in part 610 as has been described. As such, one or more series of spit-wipe operations may be performed so that the inkjet-printing device 100 subsequently properly forms images on media without image quality degradation due to air gain or water loss.

Concluding Block Diagram of Fluid-Ejection Device

Figure 10:
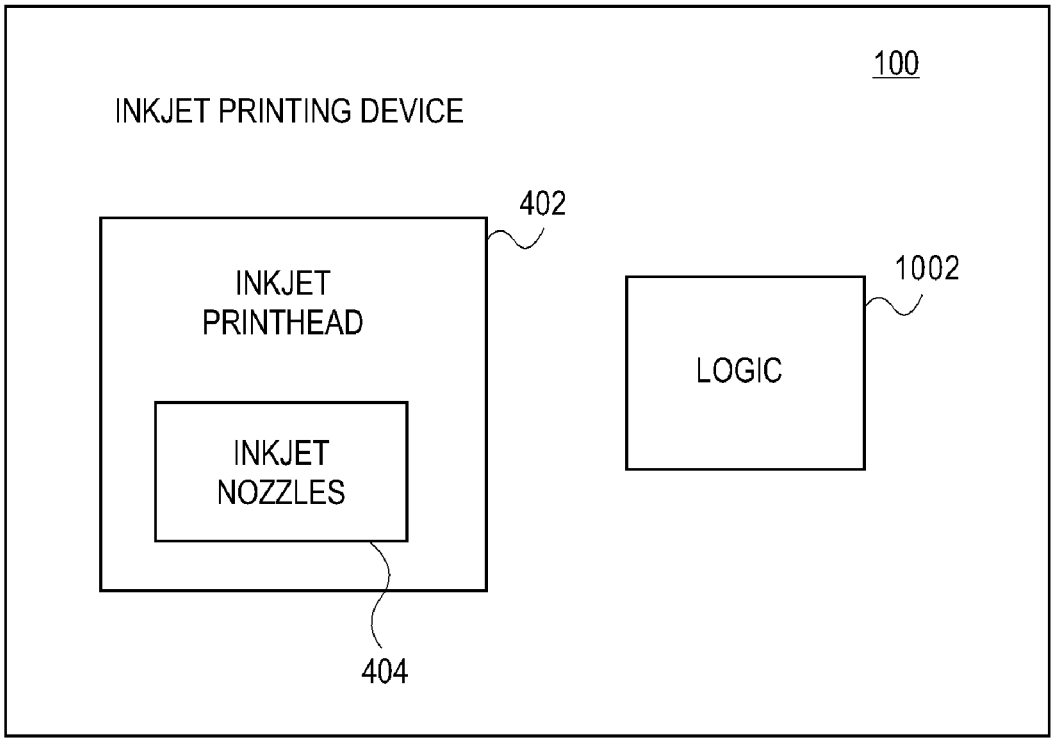
FIG. 10 is a rudimentary block diagram of an inkjet-printing device, according to an embodiment of the invention.

In conclusion, FIG. 10 shows a block diagram of the inkjet-printing device 100, according to an embodiment of the invention. As has been noted, the inkjet-printing device 100 is more generally a fluid-ejection device. The inkjet-printing device 100 is depicted in FIG. 10 as including the inkjet printhead 402 and logic 1002. As can be appreciated by those of ordinary skill within the art, the inkjet-printing device 100 may include other components, in addition to and/or in lieu of those depicted in FIG. 10. For example, the inkjet-printing device 100 may include the drop detector 902 of FIG. 9 that has been described, as well as various motors, carriages, and so on, to properly move the inkjet printhead 402 and/or the media on which the printhead 402 forms an image.

The inkjet printhead 402 is depicted as part of the inkjet-printing device 100 in FIG. 10 to denote that the inkjet-printing device 100 can include one or more of the inkjet printheads 302 that have been described. The inkjet printhead 402 is more generally an inkjet-printing mechanism, and is most generally a fluid-ejection mechanism. The inkjet printhead 402 includes a number of inkjet nozzles 404 from which ink is actually ejected. The inkjet nozzles 404 are more generally fluid-ejection nozzles that eject fluid, such as dye-based ink, pigment-based ink, or another type of ink.

The logic 1002 may be implemented in software, hardware, or a combination of software and hardware, and may be considered the means that performs various functionality. The logic 1002 can perform, or cause the inkjet printhead 402 to perform, the method 600 of FIG. 6 that has been described. Thus, the logic 1002 can cause the inkjet printhead 402 to periodically perform a non-user-initiated preventative maintenance mode so that ink is subsequently properly ejected to form images on media.

We claim:

1. A method comprising:

determining one or more preventative maintenance mode parameters for an inkjet-printing device having an inkjet-printing mechanism based on a water loss rate of water from ink within the device and/or on an air gain rate of air into the ink within the device; and, periodically performing the non-user-initiated preventative maintenance mode for the inkjet-printing device based on the preventative maintenance mode parameters to eject at least some of the ink from, and to refill fresh ink into, the inkjet-printing mechanism, comprising:

in response to the inkjet-printing device being turned on, where a time that the inkjet-printing device was off is unknown, determining a number of iterations of the non-user-initiated preventative maintenance mode of the inkjet-printing device that would have been performed if the inkjet-printing device had been on and had remained unused for a predetermined length of time, such that the time that the inkjet-printing device was off is effectively assumed to have been the predetermined length of time in determining the number of iterations of the non-user-initiated preventative maintenance mode, where the number of iterations differs depending on the predetermined length of time selected; and, performing the number of iterations of the non-user-initiated preventative maintenance mode of the inkjet-printing device.

2. The method of claim 1, further comprising determining the water loss rate of water from the ink within the inkjet-printing device.

3. The method of claim 1, further comprising determining the air gain rate of air into the ink within the inkjet-printing device.

4. The method of claim 1, wherein the preventative maintenance mode parameters comprise how often the non-user-initiated preventative maintenance mode is to be performed so that the water loss rate and the air gain rate do not sufficiently compromise the ink within the inkjet-printing mechanism to affect quality of image formation by the inkjet-printing device.

5. The method of claim 1, wherein the preventative maintenance mode parameters comprise how much of the ink is to be ejected from, and how much fresh ink is to be drawn into, the inkjet-printing mechanism during performance of the non-user-initiated preventative maintenance mode so that the water loss rate and the air gain rate to dot sufficiently compromise the ink within the inkjet-printing mechanism to affect quality of image formation by the inkjet-printing device.

6. The method of claim 1, wherein the predetermined length of time is a first predetermined length of time, and wherein periodically performing the non-user-initiated preventative maintenance mode for the inkjet-printing device comprises:

determining that the inkjet-printing device has remained on and unused for a second predetermined length of time; and, in response to determining that the inkjet-printing device has remained on and unused for the second predetermined length of time, performing one or more servicing operations for the inkjet-printing mechanism of the inkjet-printing device.

7. The method of claim 6, wherein performing the servicing operations for the inkjet-printing mechanism of the inkjet-printing device comprises performing a series of spit-wipe operations, each spit-wipe operation comprises performing a spit operation and a wipe operation, wherein performing each spit operation comprises ejecting a predetermined amount of the ink from the inkjet-printing mechanism, and wherein performing each wipe operation comprises wiping the inkjet-printing mechanism.

8. The method of claim 6, wherein the second predetermined length of time is four days, corresponding to the inkjet-printing device being turned on at a beginning of a work week of a user and turned off at an end of the work week of the user.

9. The method of claim 1, wherein periodically performing the non-user-initiated preventative maintenance mode for the inkjet-printing device comprises increasing usage of the inkjet-printing device such that average age of the ink within the inkjet-printing mechanism decreases to that of a first predetermined-percentile user and does not reach that of a second predetermined-percentile user less than the first predetermined-percentile user.

10. The method of claim 1, wherein periodically performing the non-user-initiated preventative maintenance mode for the inkjet-printing device further comprises:

in response to the inkjet-printing device being turned on, where the time that the inkjet-printing device was off is unknown, performing one or more drop detect tests to determine whether the inkjet-printing mechanism is properly ejecting the ink, such that the number of iterations of the non-user-initiated preventative maintenance mode are performed just where the inkjet-printing mechanism has failed the drop detect tests.

11. The method of claim 1, wherein the predetermined length of time is four weeks.

12. The method of claim 1, wherein periodically performing the non-user-initiated preventative maintenance mode for the inkjet-printing device comprises:

in response to the inkjet-printing device being turned on, where a time that the inkjet-printing device was off is known, determining a number of iterations of the non-user-initiated preventative maintenance mode of the inkjet-printing device that would have been performed if the inkjet-printing device had been on and had remained unused during the time that the inkjet-printing device was in actuality off, and, performing the number of iterations of the non-user-initiative prevent maintenance mode of the inkjet-printing device.

13. An inkjet-printing device comprising:

an inkjet-printing mechanism having a plurality of inkjet-printing nozzles capable of ejecting ink to form an image on media; and, logic to, in response to the inkjet-printing device being turned on, where a time that the inkjet-printing device was off is unknown, determine a number of iterations of a non-user-initiated preventative maintenance mode that would have been performed if the inkjet-printing device had been on and had remain unused for a predetermined length of time, such that the time that the inkjet-printing device was off is effectively assumed to have been the predetermined length of time in determining the number of iterations of the non-user-initiated preventative maintenance mode, where the number of iterations differs depending on the predetermined length of time selected;

where a time that the inkjet-printing device was off is known, determine the number of iterations of the non-user-initiated preventative maintenance mode that would have been performed if the inkjet-printing device had been on and had remained unused during the time that the inkjet-printing device was in actuality off;

perform the number of iterations of the non-user-initiated preventative maintenance mode of the inkjet-printing device.

14. The inkjet-printing device of claim 13, wherein the logic is further to, in response to the inkjet-printing device being turned on, where the time that the inkjet-printing device was off is unknown, perform one or more drop detect tests to determine whether the inkjet-printing mechanism is properly ejecting the ink, such that the number of iterations of the non-user-initiated preventative maintenance mode are performed just where the inkjet-printing mechanism has failed the drop detect tests.

15. The inkjet-printing device of claim 13, wherein the predetermined length of time is four weeks.

* * * * *

UNITED STATES PATENT AND TRADEMARK OFFICE

CERTIFICATE OF CORRECTION

PATENT NO. : 7,992,960 B2
APPLICATION NO. : 11/669472
DATED : August 9, 2011
INVENTOR(S) : Jennifer Marie McCord Brister et al.

It is certified that error appears in the above-identified patent and that said Letters Patent is hereby corrected as shown below:

On the title page, in field (54), Title, in column 1, line 2, delete "MAINTENACE" and insert -- MAINTENANCE --, therefor.

In column 1, line 2, delete "MAINTENACE" and insert -- MAINTENANCE --, therefor.

In column 10, line 23, in Claim 5, delete "to dot" and insert -- do not --, therefor.

In column 11, line 20, in Claim 12, delete "off," and insert -- off; --, therefor.

Signed and Sealed this
Twenty-ninth Day of May, 2012

David J. Kappos

David J. Kappos
*Director of the United States Patent and Trademark Office*